US010962331B2

(12) United States Patent
Lam et al.

(10) Patent No.: US 10,962,331 B2
(45) Date of Patent: Mar. 30, 2021

(54) DYNAMIC WEAPON TO TARGET ASSIGNMENT USING A CONTROL BASED METHODOLOGY

(71) Applicant: BAE SYSTEMS Information and Electronic Systems Integration Inc., Nashua, NH (US)

(72) Inventors: Quang M. Lam, Fairfax, VA (US); Ned B. Thammakhoune, Manchester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/433,090

(22) Filed: Jun. 6, 2019

(65) Prior Publication Data

US 2020/0386520 A1 Dec. 10, 2020

(51) Int. Cl.
*G06G 7/80* (2006.01)
*F41G 7/22* (2006.01)

(52) U.S. Cl.
CPC ..... *F41G 7/2233* (2013.01); *F41G 7/2253* (2013.01)

(58) Field of Classification Search
USPC ..... 235/411
See application file for complete search history.

(56) References Cited

U.S. PATENT DOCUMENTS 6,109,614 A * 8/2000 Ciarcia ..... F41J 5/06 235/400
6,198,694 B1 * 3/2001 Kroling ..... F41J 5/06 367/127
7,163,176 B1 * 1/2007 Geswender ..... F42B 10/64 102/400
7,520,464 B1 * 4/2009 Van Allen ..... F41G 7/222 244/3.1
2006/0187610 A1 * 8/2006 Su ..... F41H 13/0025 361/232

(Continued)

OTHER PUBLICATIONS

Lee et al., "Efficiently Solving General Weapon-Target Assignment Problem by Genetic Algorithms With Greedy Eugenics", IEEE Transactions on Systems, Man and Cybernetics—Part B: Cybernetics. vol. 33, No. 1, Feb. 2003, pp. 113-121.

(Continued)

*Primary Examiner* — Tuyen K Vo

(74) *Attorney, Agent, or Firm* — KPIP Law, PLLC; Scott J. Asmus

(57) ABSTRACT

The system and method of dynamic weapon to target assignment (DWTA) using a control based methodology to dynamically assign each projectile to a target in a multiple target engagement situation. In some cases, closest proximity is used in a real-time, to accomplish the DWTA functional requirement and performance criteria. In some cases, g pulling acceleration and projectile fin deflection motion are also used to assess the best matched pair for each projectile and each target with an end goal of intercepting the target or guiding the projectile to an acceptable error basket for target destruction via detonation. For the closest distance criterion for projectile/target pairing, a cutoff time is used to ensure the pairing is conducted within an acceptable duration while still being able to intercept the target or meet a required miss distance basket (e.g., <3 m).

19 Claims, 8 Drawing Sheets

(56) References Cited

U.S. PATENT DOCUMENTS

| | | | | |
|---|---|---|---|---|
| 2009/0039197 | A1 | 2/2009 | Maynard et al. | |
| 2009/0087029 | A1 | 4/2009 | Coleman et al. | |
| 2011/0311949 | A1 | 12/2011 | Preston et al. | |
| 2012/0211562 | A1 | 8/2012 | Cook et al. | |
| 2012/0298749 | A1* | 11/2012 | Roider | F41G 1/38 235/404 |
| 2013/0126667 | A1 | 5/2013 | Weiss et al. | |
| 2013/0255526 | A1* | 10/2013 | Sexton | F42B 7/02 102/506 |
| 2014/0373424 | A1* | 12/2014 | Silvers | F41G 1/38 42/122 |
| 2016/0178321 | A1* | 6/2016 | Peters | F41G 3/08 42/111 |
| 2016/0370147 | A1* | 12/2016 | Hancosky | F41G 1/35 |
| 2017/0328683 | A1 | 11/2017 | Smith | |

OTHER PUBLICATIONS

International Search Report, PCT/US2020/035880 dated Aug. 27, 2020, 17 pages.

* cited by examiner

Table: 30

| Weapon | Target ID | g_cmd_Mag | min Dist |
|---|---|---|---|
| 1 | 1 | 95.42 | 6076.40 |
| 2 | 2 | 81.44 | 5610.20 |
| 3 | 3 | 135.88 | 5202.63 |
| 4 | 4 | 135.88 | 6129.29 |
| 5 | 5 | 82.54 | 4838.47 |
| 6 | 6 | 79.95 | 6375.52 |

DWTA1

| | |
|---|---|
| IntialTA | order |
| DWTAOption | Closest Dista... |
| ActionCutoff | 5 |

| Weapon | Target ID | g_cmd_Mag | min Dist |
|---|---|---|---|
| 1 | 8 | 135.88 | 5135.61 |
| 2 | 16 | 135.88 | 5459.16 |
| 3 | 5 | 110.94 | 5619.99 |
| 4 | 4 | 114.55 | 5853.83 |
| 5 | 6 | 112.29 | 5877.59 |
| 6 | 1 | 115.18 | 6035.94 |

Table: 50a

DWTA2

| | |
|---|---|
| IntialTA | order |
| DWTAOption | Closest Dista... |
| ActionCutoff | 5 |

| Weapon | Target ID | g_cmd_Mag | min Dist |
|---|---|---|---|
| 7 | 16 | 135.88 | 5279.32 |
| 8 | 13 | 129.35 | 5661.15 |
| 9 | 14 | 127.14 | 5754.90 |
| 10 | 12 | 111.05 | 5956.34 |
| 11 | 10 | 111.36 | 6188.44 |
| 12 | 15 | 110.97 | 6502.39 |

Table: 50b

-DWTA1

| IntialTA | order |
|---|---|
| DWTAOption | Closest Dista... |
| ActionCutoff | 5 |

Table: 50c

| Weapon | Target ID | g_cmd_Mag | min Dist |
|---|---|---|---|
| 1 | 8 | 0.00 | 0.42 |
| 2 | 16 | 0.00 | 0.74 |
| 3 | 5 | 0.00 | 0.61 |
| 4 | 4 | 0.00 | 1.15 |
| 5 | 6 | 0.00 | 0.01 |
| 6 | 1 | 0.00 | 1.12 |

-DWTA2

| IntialTA | order |
|---|---|
| DWTAOption | Closest Dista... |
| ActionCutoff | 5 |

Table: 50d

| Weapon | Target ID | g_cmd_Mag | min Dist |
|---|---|---|---|
| 7 | 16 | 0.00 | 0.01 |
| 8 | 13 | 0.00 | 1.26 |
| 9 | 14 | 0.00 | 1.48 |
| 10 | 12 | 0.00 | 1.18 |
| 11 | 10 | 0.00 | 0.25 |
| 12 | 15 | 0.00 | 0.73 |

Table: 60a

| Weapon | Target ID | g_cmd_Mag | min Dist |
|---|---|---|---|
| 1 | 8 | 4.04 | 2668.31 |
| 2 | 7 | 4.23 | 3225.92 |
| 3 | 6 | 4.29 | 2995.52 |
| 4 | 3 | 4.39 | 3701.30 |
| 5 | 4 | 15.11 | 4107.90 |
| 6 | 1 | 4.10 | 3865.75 |

Table: 60b

| Weapon | Target ID | g_cmd_Mag | min Dist |
|---|---|---|---|
| 1 | 8 | 0.00 | 2.40 |
| 2 | 7 | 0.00 | 0.99 |
| 3 | 6 | 0.00 | 0.24 |
| 4 | 3 | 0.00 | 0.31 |
| 5 | 4 | 0.00 | 0.27 |
| 6 | 1 | 0.00 | 0.34 |

DYNAMIC WEAPON TO TARGET ASSIGNMENT USING A CONTROL BASED METHODOLOGY

FIELD OF THE DISCLOSURE

The present disclosure relates to weapon to target assignment in a multiple projectile multiple target engagement flight condition and more particularly to using a control based methodology to dynamically assign each weapon to a target after all projectiles are launched.

BACKGROUND OF THE DISCLOSURE

The Weapon to Target Assignment (WTA) function or subsystem is a well-known issue in the missile defense realm and has become even more popular for two primary missions: (1) Network Enabled Weapons (NEW) and (2) Multiple Simultaneous Engagement Technologies (MSET) missions. The WTA subsystem is typically implemented on the ground and treated as an external component of the overall missile defense system. Going back several decades, there has been little consideration to individual missiles having the capability as part of the onboard Guidance, Navigation, and Control (GN&C) subsystems to carry out such a decision making process in dynamically determining which target the missile will engage with during the early phases of a mission. Instead, missiles are typically pre-committed in launch phase, or receive in-flight target updates (IFTU) sent from a ground-based command center up to a mid-course update to engage with relocatable targets.

In general, there are two primary types of WTA processing: (1) Static WTA (SWTA) and (2) Dynamic WTA (DWTA). In the static version of WTA, all weapons are pre-assigned to incoming targets and simultaneously fired at launch time. In other words, there is no WTA action computed after launch time and damage assessment is made after all weapon-target engagements have occurred, such as the determination of the set of surviving targets for subsequent engagement actions. One drawback associated with the static WTA approach is that it cannot address time critical and emerging targets such as relocatable targets or new targets. Another drawback of static WTA is that it cannot address new targets launched by an existing platform that are not known or present at the launch time. In the dynamic version of WTA, weapons are allocated in multiple stages during fly-out with the assumption that the outcomes (i.e. survival or destruction of each target) of the weapon-target engagements of the previous stage are observed before assignment actions occur.

Wherefore it is an object of the present disclosure to overcome the above-mentioned shortcomings and drawbacks associated with the conventional (static) weapon to target assignment systems.

SUMMARY OF THE DISCLOSURE

It has been recognized that the ability to reassign multiple projectiles while in flight to respective multiple targets in motion or to newly emerging targets is highly important in modern warfare. Modern warfare calls for smart weapons to work in a collaborative network environment to communicate with one another and determine which in bound target each projectile should individually go after in order to maximize target destruction and minimize losses to assets and personnel as part of a robust defense system.

It is understood that an efficient solution to the DWTA problem is of great interest to the military. One reason for this is that, in an engagement with the enemy, the problem must be solved in real-time and subject to adversaries' asset deployment uncertainties. The enormous combinatorial complexity of such a deployment uncertainty implies that, even with the supercomputers available today, optimal solutions cannot be obtained in real-time. One must therefore develop good heuristics for solving this complex problem.

According to one embodiment the Weapon to Target Assignment (WTA) algorithms developed herein functionally compute WTA actions in real-time using two types of threat values evaluation: (1) "first see first shoot" (i.e., first projectile will engage with first target seen by a projectile) and (2) closest distance (i.e., dynamically computing relative separation distances against all targets in motion during fly out and assign projectile to hit the closest target). These two criteria also accounts for factors such as the projectile fin deflection angle motion with a secondary optimization objective to assign projectiles with more fin pulling power to the farthest targets in a weapon/target pairing.

One aspect of the present disclosure is a dynamic projectile to target assignment system, comprising: at least one targeting sensor being used to perform multiple target detection and measurements generation; the sensor with a multiple target detection and tracking (MTT), data association (DA), and track file management (TFM) subsystems, being interconnected with multiple projectiles via data link to be configured to direct the following operations: process multiple target measurement data from the at least one sensor in real-time to produce highly accurate multiple target state estimate (TSE) vectors; process multiple projectile measurement data to produce highly accurate multiple projectile state estimate (PSE) vectors to produce one or more potential projectile to target pairs; determine separation distances between each of the one or more projectiles and each of the one or more targets to prioritize projectile to target pairs based on proximity; update and maintain the projectile to target pairs as part of a TFM system; and feed output from the TFM system to a projectile target assignment system to calculate projectile guidance information such as a correct acceleration profile to guide the one or more projectiles onto an intercept course with the respective one or more targets of the one or more projectile to target pairs. In one example the projectile is guided to within a particular distance of the target and neutralizes the target by target fusing, i.e., detonating an onboard explosive device when the distance to the target becomes smaller than a predetermined value.

One embodiment of the system is wherein the sensor is part of a fire control subsystem (FCS). In some cases, the system further comprises a WTA cut-off time for determining the one or more projectile to target pairs. In one embodiment the at least one sensor is an EO/IR camera.

Another embodiment is wherein the target is on the ground or in the air at low altitude. In some cases, the fire control system is configured to perform surface-to-surface and/or surface-to-air missions.

Yet another embodiment of the system further comprises utilizing fin deflection data from the one or more projectiles in selecting projectile to target pairs.

Still yet another embodiment of the system further comprises utilizing g pulling data from the one or more projectiles in selecting projectile to target pairs.

Another aspect of the present disclosure is a method of data association in a multi-projectile/multi target system, comprising: processing data from at least one sensor in real-time; detecting one or more targets using measurement data from the at least one sensor; processing multiple target measurements and performing data association, multiple target tracking, and track file management; feeding output of the track file management to a dynamic weapon to target assignment (DWTA) function; processing multiple target state estimate vectors versus multiple projectile state vectors to determine separation distances for all projectile to target pairs; prioritizing projectile to target pairs based on proximity; updating and maintaining the projectile to target pairs; and calculating a correct acceleration profile to guide the one or more projectiles onto a collision course with the respective one or more targets of the one or more projectile to target pairs.

One embodiment of the method further comprises a cut-off time for determining the one or more projectile to target pairs. In some cases, the sensor is part of a fire control subsystem (FCS). In certain embodiments, the at least one sensor is an EO/IR camera.

Another embodiment of the method is wherein the target is on the ground or in the air at low altitude. In some cases, the fire control system is configured to perform surface-to-surface and/or surface-to-air missions.

Yet another embodiment of the method further comprises utilizing fin deflection data from the one or more projectiles in selecting projectile to target pairs.

Still yet another embodiment of the method further comprises utilizing g pulling data from the one or more projectiles in selecting projectile to target pairs.

Yet another aspect of the present disclosure is a computer program product including one or more non-transitory machine-readable mediums having operations encoded thereon that, when executed by one or more processors, result in a transform being applied to a received signal, the operations comprising: processing data from at least one sensor in real-time; detecting one or more targets and producing multiple target measurements from the at least one sensor driving a multiple target tracking (MTT) module and a track file management (TFM) module to produce multiple target state estimations (TSEs) for use in dynamic weapon to target assignment (DWTA) function processing; the dynamic weapon to target assignment (DWTA) processing determining separation distances between each of one or more projectiles and each of one or more targets (via target state estimations TSEs) to prioritize projectile to target pairs based on proximity; updating and maintaining the projectile to target pairs; and calculating a correct projectile guidance information to guide the one or more projectiles onto an intercept course with the respective one or more targets of the one or more projectile to target pairs. In one example the projectile guidance information is an acceleration profile.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1:
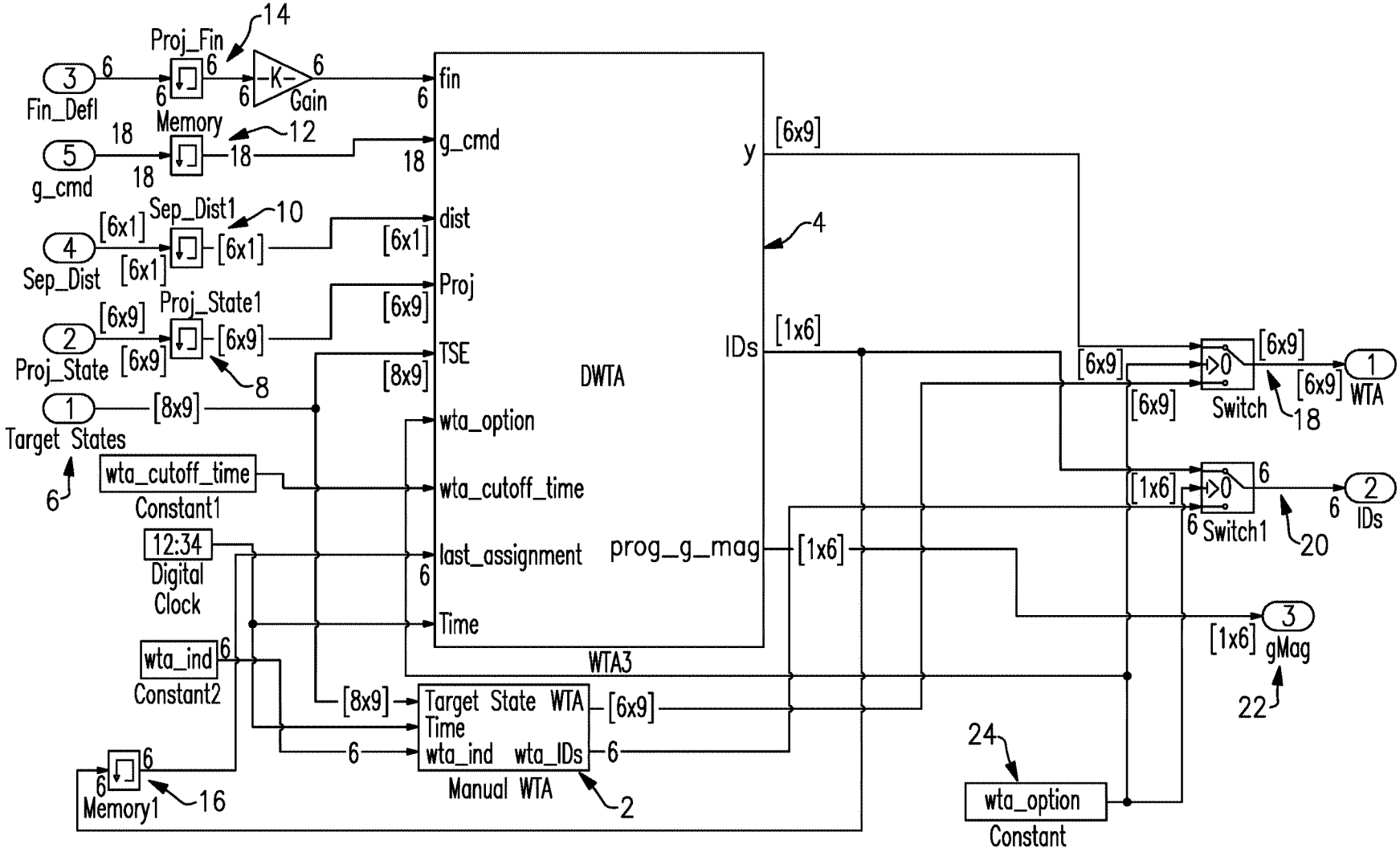
FIG. 1 shows a diagram of one embodiment of the dynamic weapon to target assignment system using a control based methodology compared to a first see first shoot system according to the principles of the present disclosure.

In certain embodiments of the present disclosure, information sharing among in flight missiles (or projectiles) is done via modern data links with sufficient bandwidths, speed, integrity and reliability. There, individual weapons' states are transparent to all in-flight missiles and these data are also accessible to a ground command center or a launching platform such as an aircraft or ground based launcher. In some cases, these cross-link information exchange among weapons are beneficial to the WTA function optimization after the communication up link from ground (or launching platform) is cutoff.

In certain embodiments, the system disclosed herein engages with targets viewed as being the largest threat to an asset (after the target identification stage). In certain cases, those with the highest values are judged in the following context: (1) a projectile sees a target first and will hit them first (i.e., first see first shoot) and (2) a projectile will destroy targets that are closest to a projectile since those are seen as the most dangerous ones that could hit first. Therefore, in certain embodiments those two criteria are employed as a good heuristic approach carrying out the DWTA calculation and performing the dynamic assignment action in real-time.

In some embodiments, sharable information about an individual weapon's control actuator dynamics and its g pulling capability vs multiple targets appears in a weapons' onboard sensor FOV. This is in contrast to having the total integrated battle space picture compiled by a ground command center. This improved data, now shareable to individual weapons, clearly offers the WTA more options to engage with the correct targets (in the context of time critical and emerging targets).

The WTA problem is generally formulated as a nonlinear integer programming problem and is known to be NP-complete. Various methods of combinatorial optimization to solve NP-complete problems have been reported in the literature. Previous WTA solutions have been developed in the following directions: Branch and bound (B&B); Variable Neighborhood Search (VNS); and using Genetic Algorithms (GA).

The WTA solution of the present disclosure takes a different path in at least the following contexts: 1) it is dynamically shaped and computed using the actual dynamic information of all weapons against all targets (i.e., separation distance from all weapons to all targets); 2) it employs these separation distances versus individual weapons' g pulling capabilities to complete the WTA; and 3) the solution is dynamic because separation distances are dynamically varied based on the fly-out geometry while individual weapons' g pulling capabilities and their fin/canards deflection positions are dictated by the external environment such as target maneuvering uncertainties (which primarily affect the target location uncertainties) and the original engagement assignment in real-time.

In certain embodiments, the WTA of the present disclosure is referred to as a Dynamic WTA (DWTA) and it uses a control based methodology. The present solution is better than current solutions for at least the following reasons: (1) the present solution is a dynamic WTA (DWTA) rather than a static WTA (SWTA), which is a single stage assignment (i.e., constant assignment throughout the entire engagement period); (2) the present DWTA solution has been carefully tested via a high-fidelity simulation and it effectively destroyed a group of targets using all in-flight projectiles; (3) the design rules are suitable for autonomous vehicles and is extendable for time critical/sensitive target engagement; and (4) the present DWTA has been implemented as a real-time (implemented at the Fire Control Center or onboard a weapon platform) software system (rather than pre-planning via a designated SWTA system).

One embodiment of the present disclosure employs several design parameters: (1) minimum separation distance among all targets vs all projectiles; (2) g pulling magnitude signatures of multiple projectiles; and (3) WTA actions settings via cut-off time. A joint condition of all three design parameters can be optimized to achieve the most effective target destruction. In some cases, a design goal is to minimize vulnerability and protect assets by engaging the closest (confirmed) targets before the target can take actions against the assets. In one embodiment, this includes using the highest g magnitude data for the projectile (since that weapon would be at full capacity and almost at maximum fin deflection), while reserving low g pulling projectiles for the targets having a longer separation distance.

Certain embodiments of the DWTA of the present disclosure will be implemented on a Fire Control Center (FCC). In some cases, the FCC will reside in a ground-based system or in a mobile launching platform. The DWTA of the present disclosure will be fed by several subsystems or components as input parameters for the system to optimize its decision making process. Some subsystems include those that provide 1) weapon flight time; 2) multiple track files; and 3) weapon in flight dynamic information (i.e., state vector and vehicle information like g (acceleration) dynamic pulling vectors and fin/canards deflection information. In some cases, the multiple track files are globally compiled via a Global Nearest Neighbor (GNN) that is hosted by the FCC and then uplinked to all of the individual weapons.

From a defense industry perspective, the DWTA of the present disclosure can be applied to smart weapons operating as a team to coordinate and determine which projectile should go after which target in order to achieve an end goal mission in a multiple target engagement condition. In a commercial context, the DWTA of the present disclosure can be used to solve the Advanced Driver Assistance System (ADAS) to achieve collision avoidance by using a minimum separation distance of the driver's vehicle versus all other surrounding vehicles to determine proper actions for the ADAS environment. Instead of engaging a nearest target like in a weapon application presented herein, the driver's vehicle would be alerted to prepare maneuvering actions to avoid incoming traffic to a avoid collision.

One embodiment of the DWTA system of the present disclosure utilizes the following:

```
function [y,IDs,proj_g_mag]=DWTA(fin,g_cmd,
dist,Proj,TSE,wta_option,wta_cutoff_time,last_assignment,
time)
% Variable Definition
% Input:
% fin_g_cmd=Commanded Acceleration in g to projectile
fin displacement
% dist_Proj_TSE_=Separation Distance Calculation from
projectile to target (TSE)
% wta_option_wta_cutoff_time=Time value used as cut-off
time for no longer having
% WTA action
% Output:
y=TSE_new=: Respective Target to Projectile Pairing
% IDs=Weapons ID (in sequential order of launching time
and target assignment will be
% conducted in that order, e.g., [1,3] [2,4], [3,5] in which
first element of the pair is
% weapon and second element is the target ID)
% proj_g_mag=Individual Projectile Acceleration in g or
m/s/s
% Dynamic Weapon to Target Assignment (DWTA) design
based on
% Projectile g pulling activity vs separation distance
%% determine nTarget and nProj based on the launching
platform capabilities
%%%
```

```
    % process in the order of weapon with the largest g first
    if wta_option==2% joint dist and g_mag option
    [srtGmag,srtIdx]=sort(proj_g_mag,'descend');
    else % distance only
    srtIdx=1:nProj; % no g_mag
    end
    assignedID=zeros(1,nProj);
    for i=1:nProj
    % exclude based on the fin depression angle (will implement after
    % closest distance is tested
    [minV,minI]=min(w2tgt_sep(srtIdx(i),:));
    assignedID(srtIdx(i))=minI;
    % assign inf to w2tgt_sep of the target that got assigned to take in
    % out of next assignment consideration to avoid being re-assigned
    w2tgt_sep(:,minI)=inf;
    end
    IDs=assignedID;
end
% update TSC_new
TSE_new=TSE(IDs,:);
y=TSE_new;
```

In other embodiments of the WTA system of the present disclosure, actual dynamic fin deflection angles are jointly considered with g pulling magnitudes. In some cases, the system provides for in-flight target updates and target swapping capabilities via an onboard DWTA.

Referring to FIG. 1, a diagram of one embodiment of the dynamic weapon to target assignment system using a control based methodology compared to a first see first shoot system according to the principles of the present disclosure is shown. More specifically, a conventional, manual, pre-planned weapon to target assignment (WTA) module 2 is shown having inputs of target state information 6, time, and the first see, first shoot input. This would mean that weapon or projectile one would be programmed to go after target one, weapon two would go after target two and so on. If there were more targets than weapons then those additional targets would not be neutralized, regardless of their location or proximity to other assets.

Still referring to FIG. 1, one embodiment of the dynamic weapon to target assignment system is shown. There, target states 6 and time are also inputs for the system of the present disclosure. However, in addition, the projectile (e.g., weapon) state information 8 is input, as well as dynamic separation distance 10 between each weapon and each target. G force information for each projectile 12 and projectile fin deflection data 14 is also input for each of the projectiles, or weapons in the system. The data is processed and updated in real-time and the weapons are assigned to a target that meets certain criteria. Each assignment is stored in memory 16 and compared to the next calculated weapon/target pairing to assign each weapon to the most appropriate target at that particular point in time. In some cases, the matching is based on proximity, or the closest target for each weapon, respectively. In some cases, the matching might be based on proximity, but will also consider the g forces for each particular weapon and its fin deflection state to determine which weapon is best suited to change its assignment and reach a newly designated target. For example, if one weapon were slightly farther away but not moving at maximum speed it might be better suited to change designations than a weapon that is closer in proximity but already at maximum speed. Output from both the conventional system 2 and the dynamic weapon to target assignment system 4 are IDs 20 and the weapon to target assignment 18. Additionally, the dynamic weapon to target assignment system 4 outputs also include g force data 22 and in some cases an optional WTA constant option 24.

Figure 2:
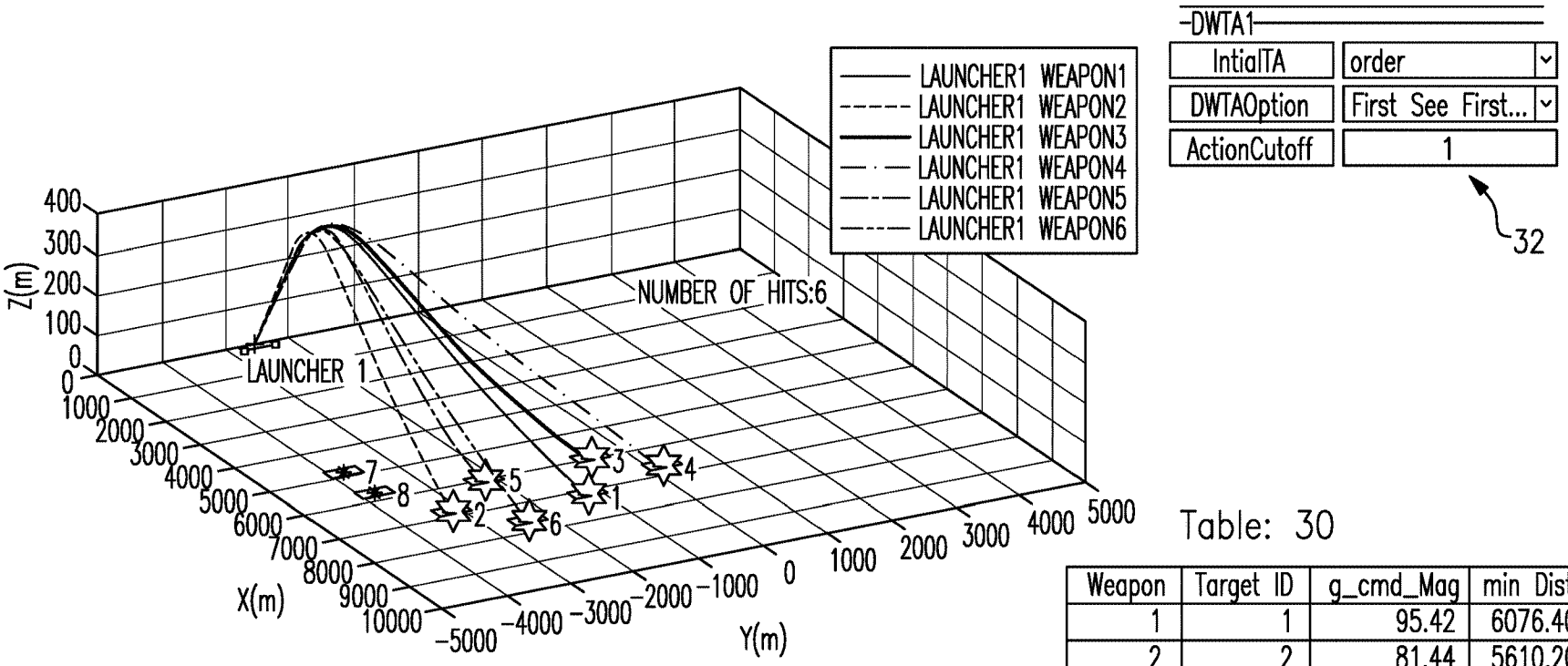
FIG. 2 shows a simulation of a conventional pre-planned, first see first shoot sequentially ordered weapon target assignment.

Referring to FIG. 2, a simulation of a conventional pre-planned, first see first shoot sequentially ordered weapon target assignment is shown. More specifically, each weapon 1-6 is matched to each target 1-6. As seen in the plot, there are two additional targets, 7 and 8. These targets are actually closer in proximity to the weapons than targets 1 and 4, yet they go untargeted and could potentially cause damage to physical assets and/or personnel. This is known as a first see, first shoot pre-planned sequential order system as found in conventional WTA systems. The table 30 shows how each weapon 1-6 is matched to target 1-6, respectively. Note that also in table 30, the g pulling magnitudes of individual projectiles are also displayed in the early phase of the fly-out, while cut-off time action for WTA 32 is set to 1 since it is pre-assigned at the launch time.

Figure 3:
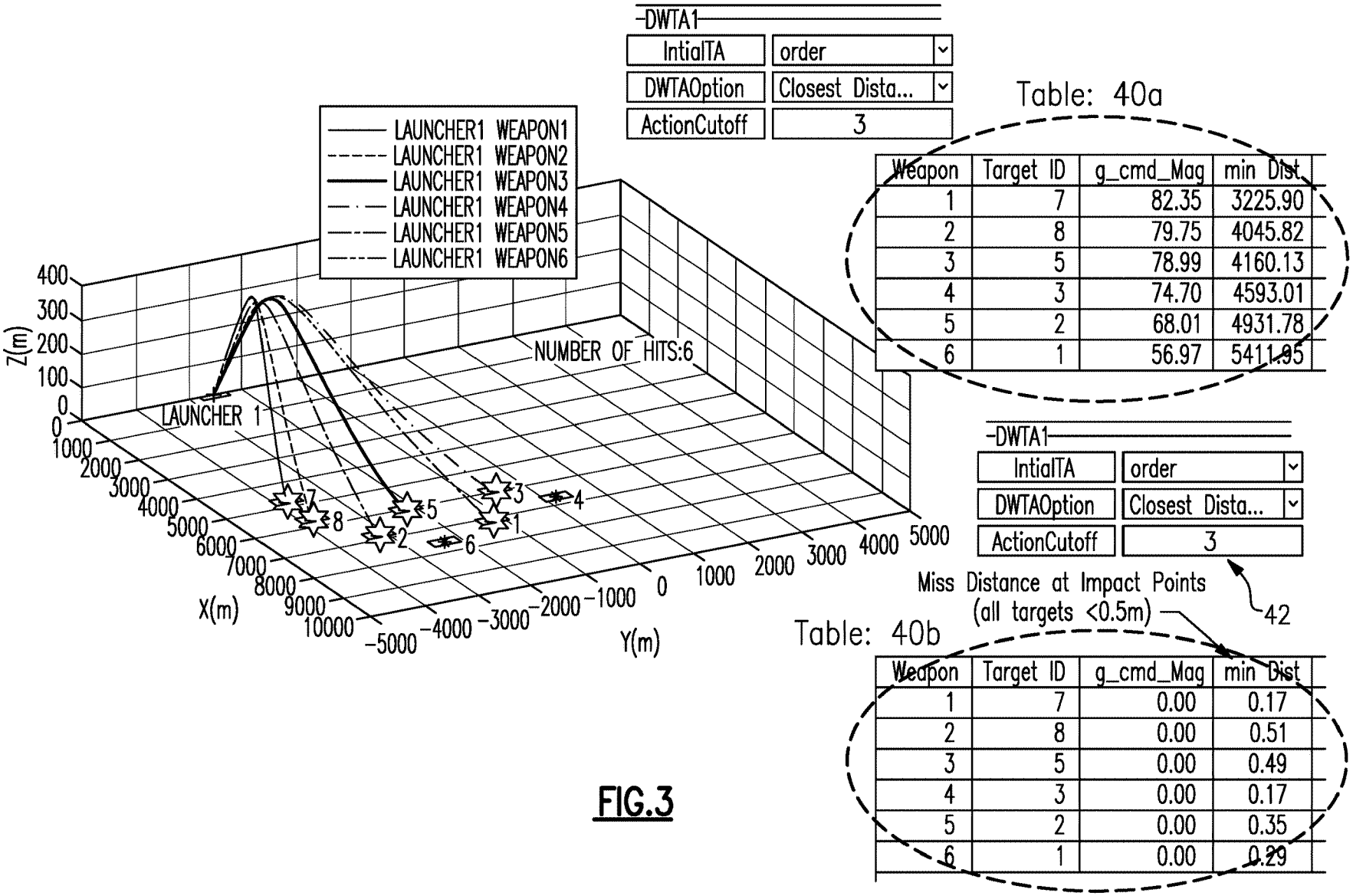
FIG. 3 shows a simulation for a dynamic weapon to target assignment system using a control based methodology according to one embodiment of the present disclosure.

Referring to FIG. 3, a simulation for a dynamic weapon to target assignment system using a control based methodology according to one embodiment of the present disclosure is shown. More specifically, here, two WTA criteria are used. They are closest target per weapon and joint closest target and weapon g-pulling. As table 40*a* and Table 40*b* show, bullet 1 is matched to target 7, bullet 2 is matched to target 8, bullet 3 is matched to target 5, bullet 4 is matched to target 3, bullet 5 is matched to target 2, and bullet 6 is matched to target 1. This leaves targets 6 and 4 (the farthest out) yet to be hit since they are not matching with our current DWTA criteria selection. Under this DWTA selection, the cut-off time for DWTA action 42 is set to 3 seconds allowing the solution to be searched/computed during the first three seconds of the fly-out. Table 40*a* represent during flight (see g magnitude is not zero), and Table 40*b* represents at end-game time (after hit) g pulling is zero. The cut-off time is calculated based on several factors including the time it takes to process the dynamic real-time data and determine updates, the time it takes to transmit the updates to the projectiles, and the time it takes for the projectiles to implement the changes such that it can intercept the target.

Figure 4A:
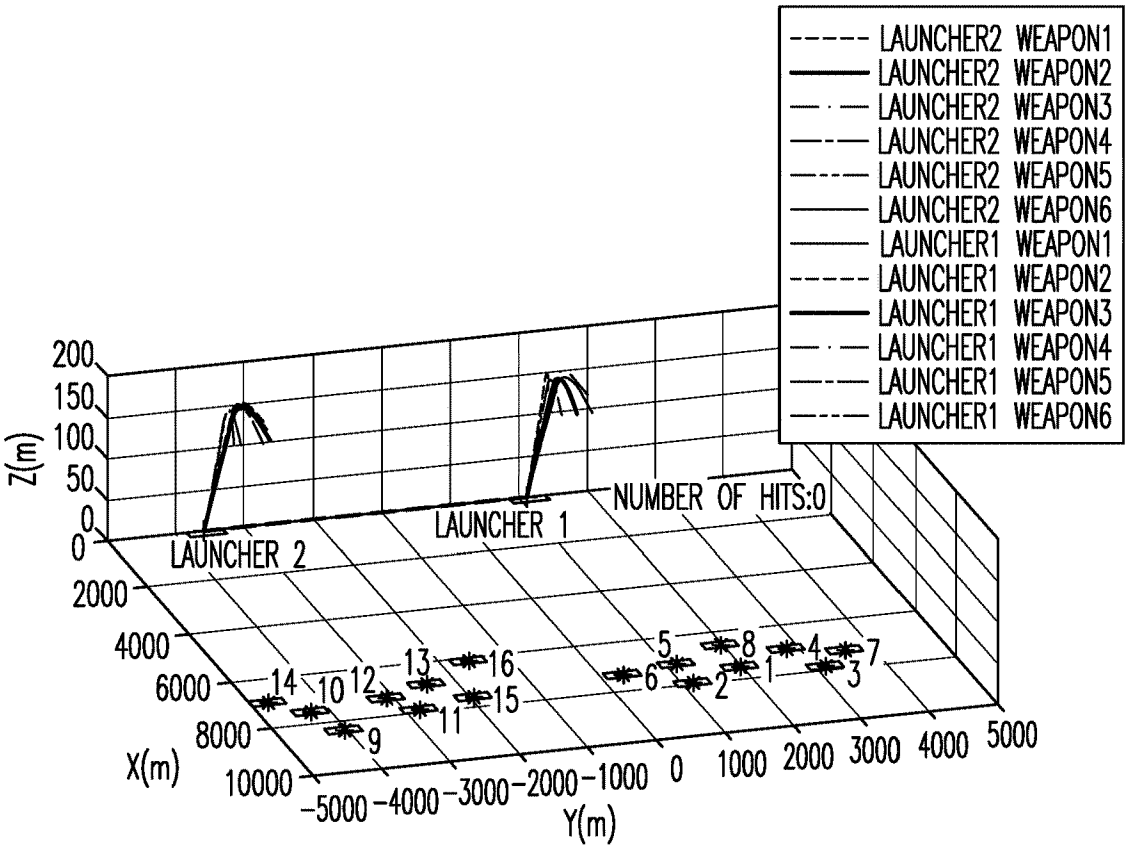
FIG. 4A and FIG. 4B show simulations for a dynamic weapon to target assignment system using a control based methodology according to another embodiment of the present disclosure with ground-based targets.
Figure 4B:
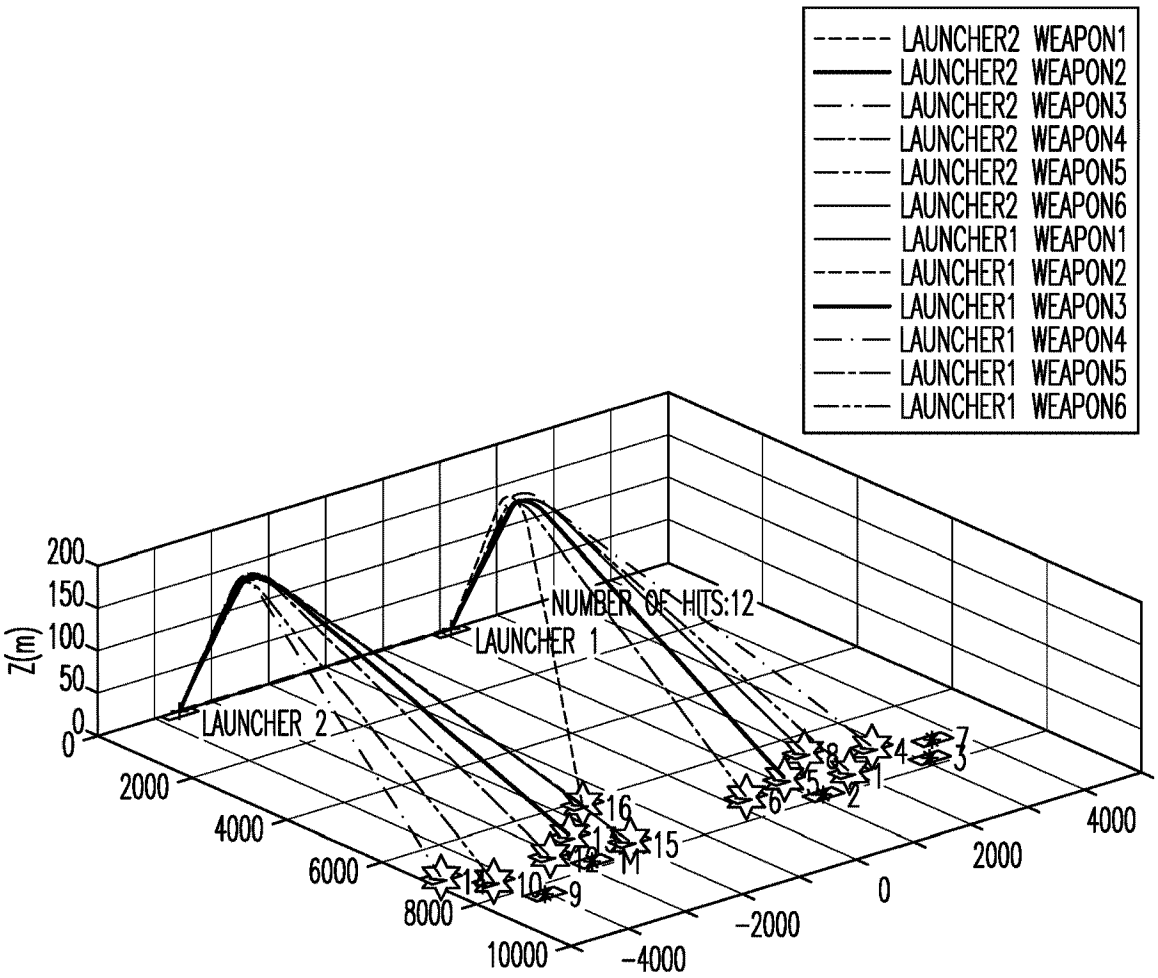

Referring to FIG. 4A and FIG. 4B, simulations for a dynamic weapon to target assignment system using a control based methodology according to another embodiment of the present disclosure is shown. More specifically, FIG. 4A illustrates the effectiveness of the closest distance criterion DWTA engagement for a two ground-based vehicle operation against a group of ground-based vehicles operated by an adversary. Both Launcher 1 and Launcher 2 are seeing target 16 as their closest threat and autonomously go after this target 16 while the rest of the targets are engaged accordingly using the DWTA algorithm. Also in FIG. 4A, the DWTA action cut-off time is set to 5 seconds while g pulling magnitudes of individual projectiles are also considered as part the DWTA decision making process. FIG. 4B presents the effectiveness of the DWTA applied to a two ground-based vehicle operation for which at end-game time, the two ground-based vehicles have been able to destroy all targets which are deemed to be the most eminent threats to the assets. More specifically, here, several WTA criteria were used. First, closest target per weapon and joint closest target and weapon g-pulling are used.

As per standard protocol, only 6 weapons were fired at a time so that is what was used in this simulation. Here, as table 50*a* and Table 50*b* shows bullet 1 is matched to target 8, bullet 2 is matched to target 16, bullet 3 is matched to target 5, bullet 4 is matched to target 4, bullet 5 is matched to target 6, and bullet 6 is matched to target 1. Bullet 7 is matched to target 16 (as was Launcher 1, bullet 2), bullet 8 is matched to target 13, bullet 9 is matched to target 14, bullet 10 is matched to target 12, bullet 11 is matched to target 10, and bullet 12 is matched to target 15. This is an in-flight, real-time dynamic weapon to target assignment system. Table 50*a* and 50*b* represent during flight (see g magnitude is not zero), and Table 50*c* and 50*d* represents at end-game time (after hit) g pulling is zero. At end-game time, the miss distances ranged from 1.5 m to 0.1 m.

Figure 5A:
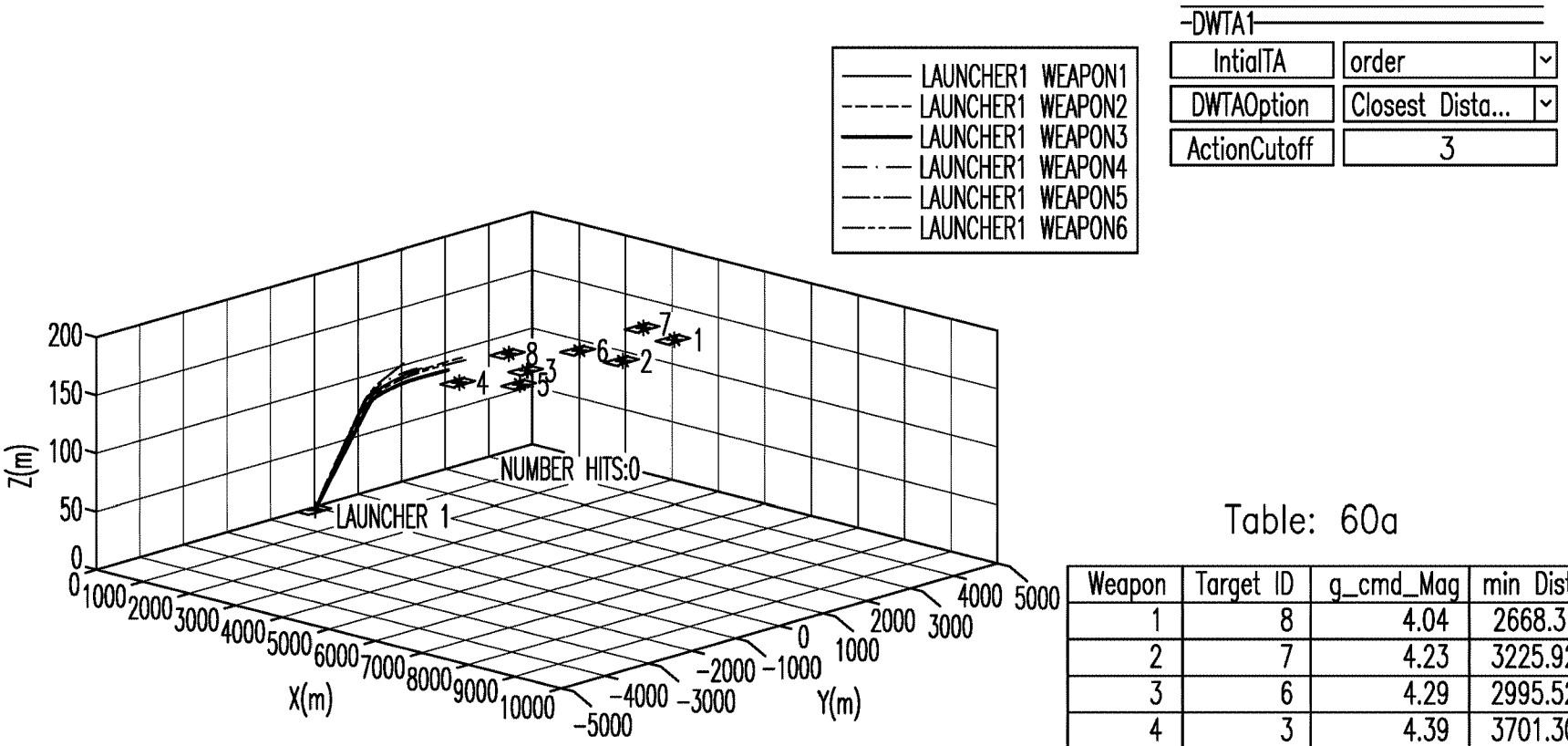
FIG. 5A and FIG. 5B show simulations for a dynamic weapon to target assignment system using a control based methodology according to another embodiment of the present disclosure with maneuvering flying targets.
Figure 5B:
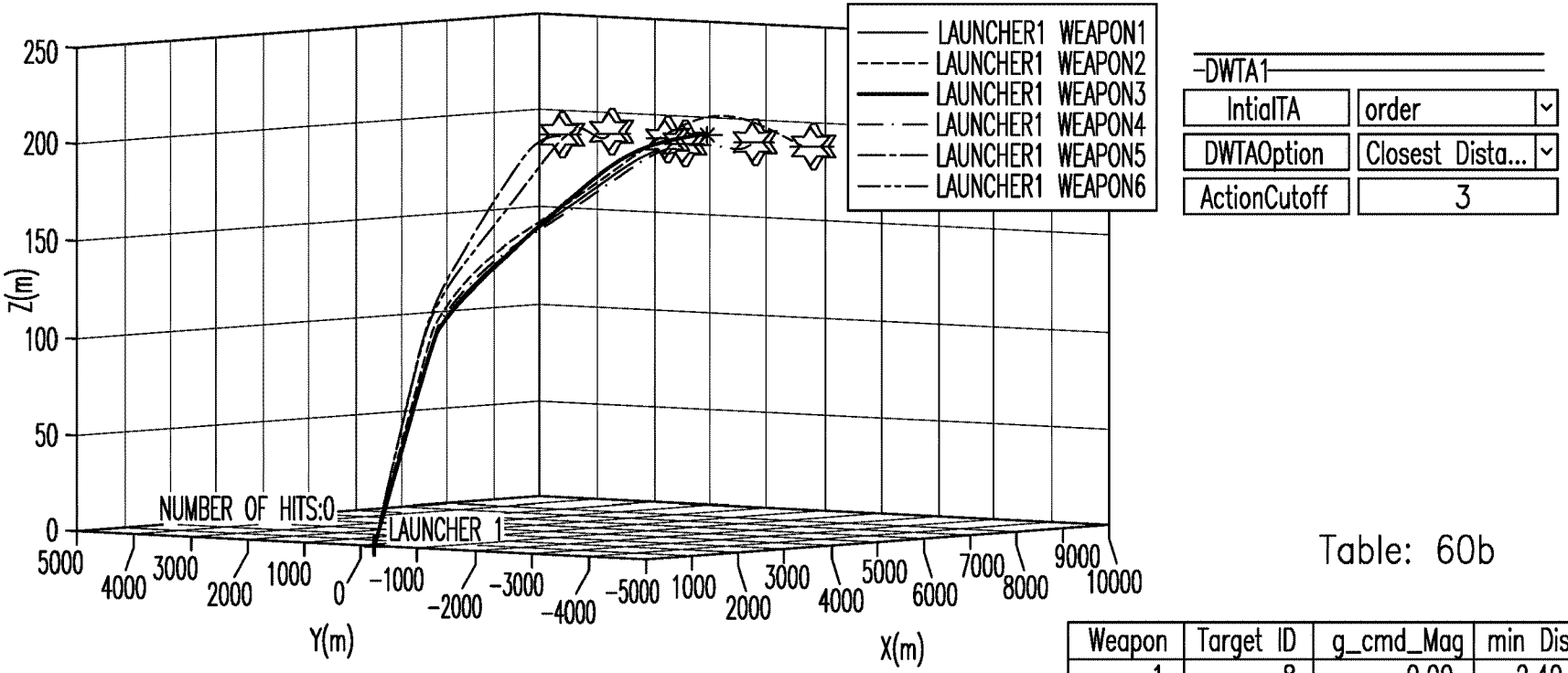

Referring to FIG. 5A and FIG. 5B, simulations for dynamic weapon to target assignment systems using a control based methodology according to another embodiment of the present disclosure are shown. More specifically, here, the DWTA has been applied to a maneuvering short air defense (M-SHORAD) mission to engage with low altitude UAVs operated by an adversary. FIG. 5A presents the early fly-out portion of the mission which illustrate DWTA cut-off time set at 3 seconds and g pulling magnitude of individual projectiles against respective UAVs. FIG. 5B presents the end result of the mission which successfully destroyed all the targets at end-game time using the proposed DWTA presented in this present disclosure.

Here, as table 60*a* shows the dynamic WTA selects different targets to engage based on a different cut-off time. This relates to time sensitive target assignment and engagement. Here, bullet 1 is matched to target 8, bullet 2 is matched to target 7, bullet 3 is matched to target 6, bullet 4 is matched to target 3, bullet 5 is matched to target 4, and bullet 6 is matched to target 1. This is an in-flight, real-time dynamic weapon to target assignment system. Table 60*a* represents during flight (see g magnitude is not zero), and Table 60*b* represents at end-game time (after hit) g pulling is zero. At end-game time, the miss distances ranged from 2.4 m to less than 0.5 m.

Figure 6:
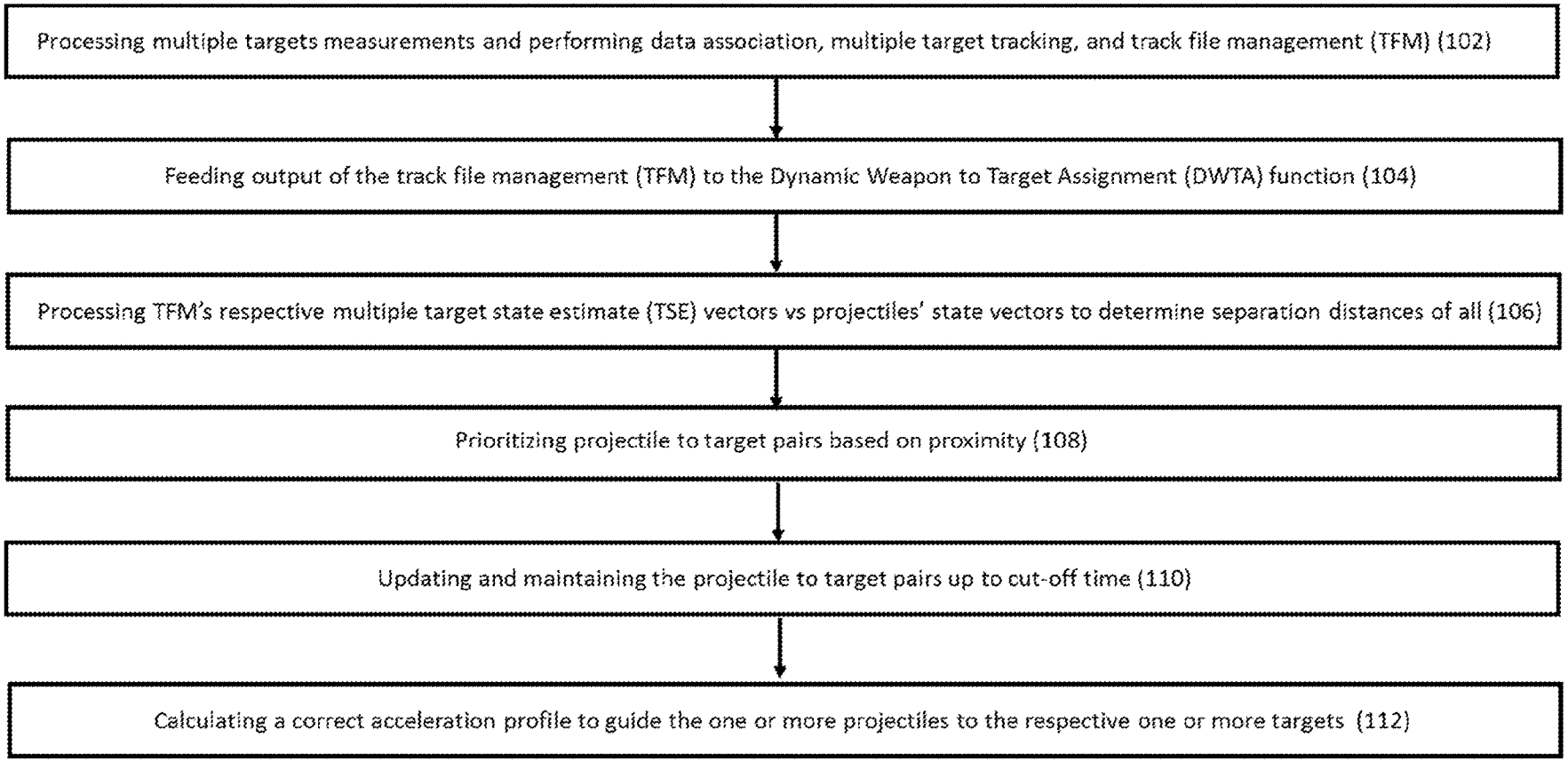
FIG. 6 is a flow chart of one embodiment of a method of the present disclosure.

Referring to FIG. 6, a flow chart of one embodiment of a method of the present disclosure is shown. More specifically, data from the at least one sensor is processed and in one example the data is in real-time. One or more target location measurements are detected for one or more targets using the data from the at least one sensor to produce one or more potential projectile to target pairs. Multiple target measurements are processed and data association, multiple target tracking, and track file management are preformed 102. Output of the track file management is fed to a dynamic weapon to target assignment (DWTA) function 104. Multiple target state estimate vectors versus multiple projectile state vectors are processed to determine separation distances for the projectile to target pairs 106. Projectile to target pairs are prioritized based on proximity 108. The potential projectile to target pairs are updated and re-assigned as needed and maintained as part of a track file management (TFM) system 110. Correct acceleration profiles are calculated to guide the one or more projectiles onto an intercept course with the respective one or more target of the one or more projectile to target pairs 112.

The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

The DWTA of the present disclosure may be implemented as ground based software at the fire control center residing in a ground-based vehicle or at a command and control center, which may be supplied on a storage medium or via a transmission medium such as a local-area network or a wide-area network. The DWTA described herein can also be implemented on a larger weapon system as an onboard DWTA for future missiles intended to operate in a collaborative environment. Data link is used for cross communicating and data sharing among these smart weapons. It is to be further understood that, because some of the constituent system components and method steps depicted in the accompanying Figures can be implemented in software, the actual connections between the systems components (or the process steps) may differ depending upon the manner in which the present system is programmed. Given the teachings of the present system provided herein, one of ordinary skill in the related art will be able to contemplate these and similar implementations or configurations of the present system.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A dynamic projectile to target assignment system, comprising:

one or more processors present on a field programmable gate array (FPGA) configured to execute the instructions stored on the FPGA, wherein execution of the instructions causes the one or more processors to perform the following:

process a plurality of target measurement data to produce multiple target state estimate vectors;

process a plurality of projectile measurement data to produce multiple projectile state vectors to produce one or more potential projectile to target pairs;

determine separation distances between each of the one or more projectiles and each of the one or more targets from the potential projectile to target pairs;

matching based on proximity and g pulling magnitude to produce one or more updated projectile to target pairs;

maintain the updated projectile to target pairs as part of a track file management system; and feed output from the track file management system to a projectile target assignment to calculate a correct acceleration profile to guide the one or more projectiles to intercept the respective one or more targets.

2. The system according to claim 1, further comprising at least one sensor being used to provide multiple target detection and measurements generation; the sensor being in communication with a multiple target detection and tracking (MTT), data association (DA), and track file management (TFM) subsystems.

3. The system according to claim 2, wherein the fire control system is designed in a ground-based system or in a mobile launching platform.

4. The system according to claim 1, wherein the sensor is part of a fire control subsystem (FCS).

5. The system according to claim 1, further comprising a cut-off time for determining the one or more projectile to target pairs.

6. The system according to claim 1, wherein the at least one sensor is an electro-optical/infrared (EO/IR) camera.

7. The system according to claim 1, wherein the target is on the ground or in the air at low altitude.

8. The system according to claim 1, further comprising utilizing fin deflection data from the one or more projectiles to produce the one or more updated projectile to target pairs.

9. The system according to claim 1, further comprising matching the projectile to target pairs to intercept a different one of the one or more targets, thereby allowing the one or more projectiles to reach a newly designated target.

10. A method of data association in a multi-projectile/multi target system, comprising:

processing data from at least one sensor in real-time;

detecting one or more targets using measurement data from the at least one sensor;

processing multiple target measurements and performing data association, multiple target tracking, and track file management;

processing multiple target state estimate vectors versus multiple projectile state vectors to determine separation distances for the projectile to target pairs;

prioritizing projectile to target pairs based on proximity;

updating and maintaining the projectile to target pairs;

calculating a correct acceleration profile to guide the one or more projectiles to intercept the respective one or more targets of the one or more projectile to target pairs; and re-assigning the one or more projectiles during flight to intercept a different one of the one or more targets, thereby allowing the one or more projectiles to reach a newly designated target 11. The method according to claim 10, further comprising a cut-off time for determining the one or more projectile to target pairs.

12. The method according to claim 10, wherein the sensor is part of a fire control subsystem (FCS).

13. The method according to claim 12, wherein the fire control system is designed in a ground-based system or in a mobile launching platform.

14. The method according to claim 10, wherein the at least one sensor is an electro-optical/infrared (EO/IR) camera.

15. The method according to claim 10, wherein the target is on the ground or in the air at low altitude.

16. The method according to claim 10, further comprising utilizing fin deflection data from the one or more projectiles in selecting projectile to target pairs.

17. The method according to claim 10, further comprising utilizing g pulling data from the one or more projectiles in selecting projectile to target pairs.

18. A computer program product including one or more non-transitory machine-readable mediums having operations encoded thereon that, when executed by one or more processors, result in guidance information being applied to a projectile, the operations comprising:

processing data from at least one sensor;

detecting one or more targets and producing corresponding target measurements from at least the one sensor data to produce target state estimations (TSEs);

processing a plurality of projectile measurement data to produce one or more projectile state estimate (PSE) vectors to produce one or more potential projectile to target pairs;

determining separation distances between each of the one or more projectiles and each of the one or more targets using the TSEs to prioritize projectile to target pairs based on proximity;

calculating a correct guidance information to guide the one or more projectiles onto an intercept course with the respective one or more targets by the one or more projectile to target pairs;

determining separation distances between each of the one or more projectiles and each of the one or more targets from the potential projectile to target pairs;

matching the projectile to target pairs based on proximity and g pulling magnitude to produce one or more updated projectile to target pairs;

updating and maintaining the updated projectile to target pairs as part of a track file management (TFM) system;

feeding output from the track file management (TFM) system to a projectile target assignment system to calculate a correct acceleration profile to guide the one or more projectiles onto a collision course with to intercept the respective one or more targets of the one or more projectile to target pairs.

19. The computer program product according to claim 18, further comprising utilizing fin deflection data from the one or more projectiles to produce the one or more updated projectile to target pairs.

* * * * *